US006598810B2

(12) United States Patent
Lanteri

(10) Patent No.: US 6,598,810 B2
(45) Date of Patent: Jul. 29, 2003

(54) FIRE HOSE LANCE

(75) Inventor: Louis Lanteri, Pont sur Seine (FR)

(73) Assignee: POK, Nogent sur Seine (FR)

( * ) Notice: Subject to any disclaimer, the term of this patent is extended or adjusted under 35 U.S.C. 154(b) by 179 days.

(21) Appl. No.: 09/747,526

(22) Filed: Dec. 7, 2000

(65) Prior Publication Data

US 2001/0020650 A1 Sep. 13, 2001

(30) Foreign Application Priority Data

Dec. 7, 1999 (FR) ..... 99 15789

(51) Int. Cl.[7] ..... B05B 1/32; B05B 1/30; B05B 1/34; B05B 1/26

(52) U.S. Cl. ..... 239/452; 239/533.1; 239/456; 239/459; 239/524

(58) Field of Search ..... 169/14, 15; 239/451, 239/452, 453, 456, 459, 518, 521, 523, 524, 526, 533.1, 581.1, 581.2, 569–571, 579, 541; 138/46; 251/120–121; 137/494

(56) References Cited

U.S. PATENT DOCUMENTS 2,991,016 A * 7/1961 Allenbaugh, Jr. ..... 239/458
3,387,791 A * 6/1968 Allenbaugh, Jr. ..... 239/458
3,539,112 A * 11/1970 Thompson ..... 239/452
3,863,844 A * 2/1975 McMillan ..... 239/452
3,893,624 A * 7/1975 Thompson ..... 239/107
3,904,125 A * 9/1975 Allenbaugh ..... 239/452
4,172,559 A * 10/1979 Allenbaugh, Jr. ..... 239/453
4,252,278 A * 2/1981 McMillan ..... 239/583
5,312,048 A * 5/1994 Steingass et al. ..... 239/441
6,007,001 A * 12/1999 Hilton ..... 239/452

FOREIGN PATENT DOCUMENTS

| | | |
|---|---|---|
| GB | 2 297 930 A | 8/1996 |
| WO | 95/17926 | 7/1995 |
| WO | 99/30828 | 6/1999 |

* cited by examiner

*Primary Examiner*—Michael Mar
*Assistant Examiner*—Darren Gorman
(74) *Attorney, Agent, or Firm*—Nixon & Vanderhye

(57) ABSTRACT

The present invention relates to a fire hose lance comprising a body (1) including a pressure control device comprising a valve (44) partly closing up an axial drill hole (320) of a piston (32) mounted in the body (1) of the lance, characterized in that valve (44) is fixedly mounted on the body (1), piston (32) is slidably mounted in the body (1), wherein movement of the piston (32) is caused, on the one hand, by the force resulting from the fluid's total pressure exerted on the surface (D1) of the piston located opposite valve (44) and on the other hand, by the force exerted by restoring means (31) tending to neutralize the resulting force from the fluid pressure.

7 Claims, 2 Drawing Sheets

FIRE HOSE LANCE

FIELD OF THE INVENTION

The present invention relates to a fire hose lance. It is known that most fire hose lances comprise a pressure control device for preventing a too large recoil when opening the lance. This device also enables constant pressure to be maintained even if the water flow rate varies, which may facilitate use of the lance. However, pressure control devices of the prior art suffer from the drawback of increasing the weight of the fire hose lance and therefore making the latter less handy.

Accordingly, the object of the present invention is to overcome the drawbacks of the prior art by providing a fire hose lance which may easily be manoeuvred and is less cumbersome.

BRIEF DESCRIPTION OF DRAWINGS

The present invention with its features and advantages will become more apparent on reading the description hereafter, made with reference to the appended drawings wherein.

DESCRIPTION OF THE PREFERRED EMBODIMENTS

Figure 2:
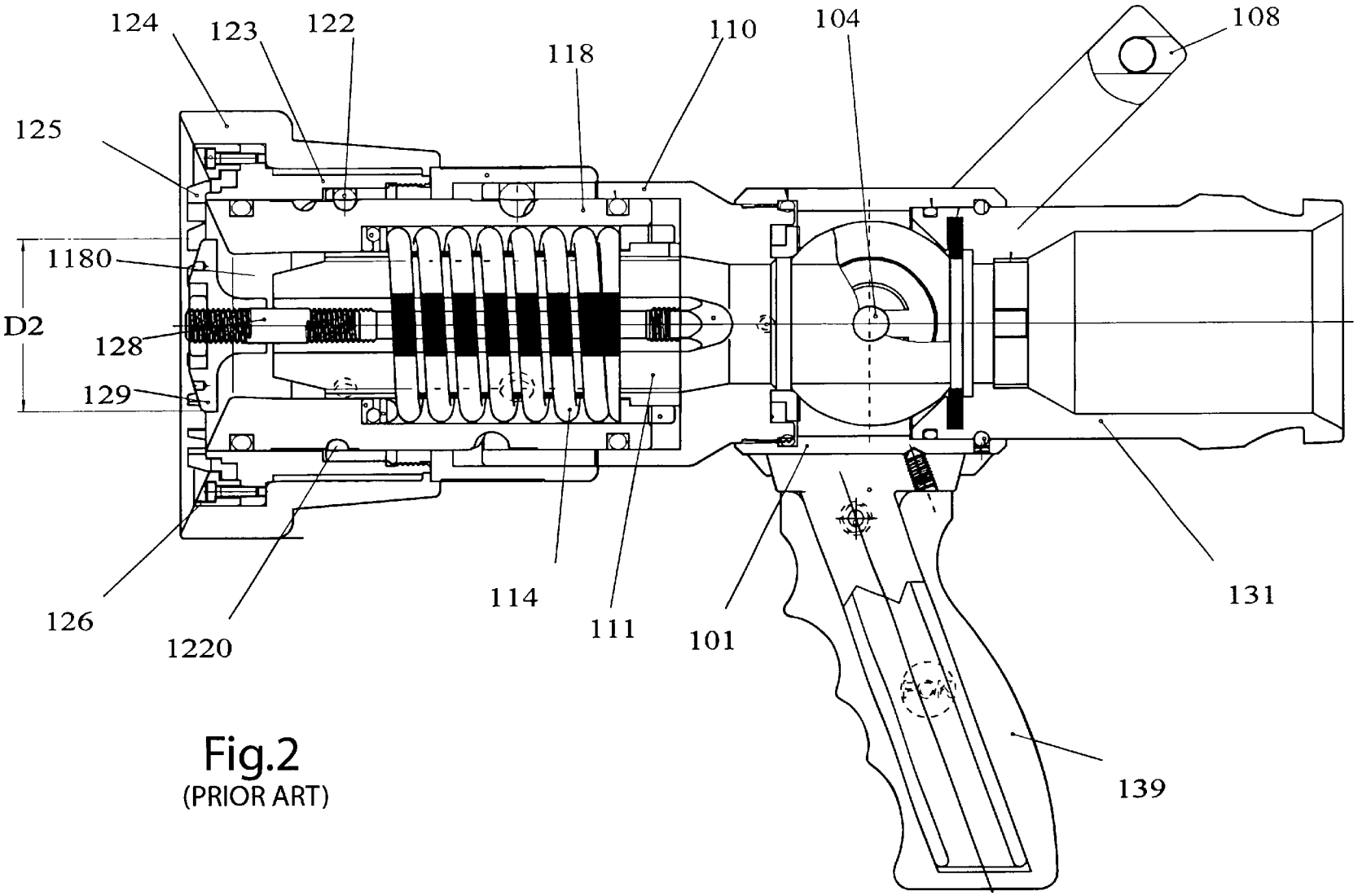
Fig.2 (PRIOR ART)
FIG. 2 shows a longitudinal sectional view of a fire hose lance according to the prior art.

In order to better understand the features of the fire hose lance according to the invention, as compared with fire hose lances of the prior art, firstly, it is necessary to describe the operating and pressure control principle in an example of a fire hose lance of the prior art, illustrated in FIG. 2. According to the prior art, a fire hose lance comprises a body (101) of a generally cylindrical shape, a first end of which comprises a connector (131) for connecting a water feed conduit. The body also comprises a grip handle (139) of the gun handle type and a manoeuvring handle (108) for actuating the spindle (104) of the lance's stopcock in the opening or closing direction. The second end of body (1) comprises a sleeve (110) connected to body (101) by a thread and comprises a diffusion head. This diffusion head comprises a turbine (125) mounted with a diffusion cone (126) on a fixed nozzle (113) in front abutment with respect to sleeve (110). Assembly is achieved, via a head ring (123) sliding on nozzle (118). This turbine (125) enables a different water jet to be produced, depending on the position of the whole formed by the turbine (125), the head ring (123), on sleeve (110). The nozzle (118) is substantially of a cylindrical shape and comprises an axial drill hole (1130) which allows the fluid to flow through the lance. A manoeuvring and protective sheath (124) is attached, for example forcibly, on the head ring (123) and allows the operator to rotate this ring (123) on the nozzle. The rotary movement of the sliding ring (123) is guided by at least a ball (122) attached to the ring (123) which slips in a helical ramp (1220). In such a way, by screwing or unscrewing the ring (123), a different diffusion pattern is obtained, for example a full jet or a diffusion cone, by changing the position of the head ring (123) with respect to the nozzle (118).

The diffusion head also comprises a disc-shaped valve (129) mounted in the nozzle (118) and partly closing the fluid's outlet, in order to form with the turbine (125) and the diffusion cone (126), the desired jet shape, depending on the position of the head ring (123). Thus, the fluid is guided by the internal portion of valve (129) against the nozzle (118), then through the turbine (125), before being diffused towards the outside of the lance. According to the prior art, pressure control is performed by varying the gap between the mobile valve (129) along the lance's axis and the nozzle (118) according to the fluid's flow rate. The higher the flow rate, the larger this gap must be in order to reduce pressure within the lance's body. For this purpose, the valve (129) is attached to a spindle (128) fixed on a seat (111) on which rests a first end of a coil spring (114), a so-called control spring. This spring (114) is mounted inside the body (101) and more particularly inside nozzle (118). The second end of control spring (114) rests against nozzle (118). In the rest position, i.e. when no fluid is flowing in the body (101) of the lance, the control spring (114) exerts a restoring force on valve (129) which tends to reduce the gap between valve (129) and nozzle (118). When a fluid flows through the nozzle, it comes and exerts a pressure on the whole surface of the interior portion of valve (129). In other words, the control spring is subject to stress from a static pressure, due to the presence of the fluid and from a dynamic pressure, due to the displacement of the fluid, which is exerted on the whole surface of the transverse section (D2) of valve (129). Control is thus achieved by the restoring force of the spring (114) which the fluid must overcome in order to push away the valve (129) from the nozzle (118). Thus, the stiffness of spring (114) is adapted for overcoming the total pressure exerted on the whole surface area of the section of the valve (129). As explained previously, the higher the fluid flow rate, the greater the pressure force exerted by the fluid on the valve and the more the latter tends to move away from the nozzle in order to reduce the pressure increase on valve (129). This configuration therefore requires that significant stiffness be provided for the control spring (114) as the latter must face up to a pressure force from the fluid which is exerted on the whole surface area of the section of the valve (D2). However, by increasing the spring's stiffness, its weight and its bulk are also increased and consequently the volume of the lance. Furthermore, the control spring (114) is housed in the conduit for fluid flow, it is therefore continually immersed and must therefore undergo a specific treatment, which increases the total cost for the lance.

Before describing the lance, according to the invention, the hydraulic principles which are at work in the control phenomenon should be recalled. It is known that when a fluid escapes out of a nozzle having a constant passage section, pressure within the nozzle increases as the square of the flow rate according to a parabolic law. This expresses the fact that if the user desires to vary the flow rate in the fire hose lance, which is commonplace depending on the extension of the fire, then the internal pressure is also increased very significantly, which causes the recoil phenomenon.

The control principle is that the section for the liquid's passage delimited by the valve and the nozzle is no longer constant but on the contrary is automatically variable depending on the hydraulic stresses combined with the variable stress of a control spring. This control spring automatically adjusts the section of the nozzle so that, at any time, pressure remains constant inside the lance regardless of the fluid's flow rate.

The lance, according to the invention will now be described with reference to FIG. 1. The lance, according to the invention, comprises a body (1) provided with a connector (50) so that it may be connected to a feed conduit. The body (1) comprises a gun grip handle (21) and a manoeuvring handle (8) for the stopcock (2) of the nozzle. The diffusion head (41) essentially comprises the same components as the lance of the prior art, notably the diffusion head comprises a turbine (38) which provides a different fluid jet, according to its position on a piston (32). This turbine (38) is mounted with a diffusion cone (39) on piston (32) mounted in sleeve (11), itself screwed onto the second end of body (1). The cone and turbine are mounted on piston (32) through a sliding ring (35) on piston (32). Piston (32) also comprises an axial drill hole (320) in which valve (44) is housed. The fundamental difference of the lance according to the invention lies in the control mechanism.

Unlike the prior art, valve (44) of the lance according to the invention is fixed relatively to the sleeve (11) and therefore to the body (1), and piston (32) is slidably mounted in sleeve (11). Thus, pressure control is achieved by the movement of piston (32) when the resulting force from the total pressure exerted on the piston's surface located opposite the valve (42), is sufficient for overcoming the resistance from restoring means which tend to maintain the piston (32) against the valve (44). Thus, by moving the piston (32) relatively to the fixed valve (42), the passage section between piston (32) and valve (44) will be adjusted so that the pressure inside the lance will be constant. When the flow rate is stable, the section of the passage does not change. As a result, piston (32) is stationary. If the flow rate increases, even suddenly, the pressure exerted on piston (32) will increase as the square of the flow rate. Therefore, under the effect of the fluid's pressure force, the passage section will increase automatically and almost instantaneously by the movement of piston (32) subject to the effect of the fluid's pressure force. Also, if the flow rate is reduced, even suddenly, the pressure exerted on piston (32) will be reduced as the square of the flow rate. Therefore, the passage section will be reduced automatically and almost instantaneously by the movement of piston (32) in order to maintain constant pressure within the nozzle.

Remarkably, the spring has only to oppose the resulting force from the pressure exerted on piston (32) in order to move it, whereby this force is much lower than the force resulting from the pressure exerted on the surface of the valve (129, FIG. 2) of the prior art. Indeed, the surface area (D1) on which pressure is exerted for moving the piston (32) is reduced as compared with the internal surface area of valve (129, FIG. 2) of the prior art. This surface (D1) in fact corresponds to a ring with an internal diameter matching the diameter of the axial drill hole (320) of piston (32) and with an external diameter matching the diameter of valve (44). Further, the total pressure exerted on piston (32) essentially matches the dynamic pressure of the fluid. Indeed, at the outlet of valve (44), taking into account that that fluid is almost in free air, experiments have proved that the pressure in any point of the fluid is essentially equal to atmospheric pressure.

Finally, the end of piston (32) opposite valve (44) is conical and the direction of the fluid flux forms a low angle, less than 90°, with the conical surface of the end of piston (32), which also reduces the resulting force from the dynamic pressure.

This reduction of the force acting on piston (32) results in that the restoring means (31) which provide the control by monitoring the motion of the piston, exert much lower reaction forces against pressure than the reaction force exerted by the control spring (114) of the lance of the prior art. Thus, the restoring means may have a more lightweight design which reduces the volume of the lance and therefore its weight, which improves its handling.

As previously explained, valve (44) is mounted fixed on sleeve (11) fixed on the second end of body (1). For this purpose, the valve is mounted on a spindle (42) by means of a nut (45). The valve's spindle (42) is fixed on a nose cone (43) attached to a cross-piece (26) attached to sleeve (11). Watertightness between cross-piece and body (1) is provided by an O-ring (27). According to the alternative embodiment illustrated in FIG. 1, the restoring means comprise a coil spring (31), a so-called control spring, mounted in the axial drill hole (320) of piston (32), wherein the axis of the control spring (31) essentially coincides with the axis of the axial drill hole (320). A first end of spring (31) is then attached to piston (32). The second end of control spring (31) is fixed to body (1) or to a fixed component relatively to body (1). According to the alternative embodiment illustrated in FIG. 1, the second end of control spring (31) is attached to a purge ring (30) translatably attached to sleeve (11), for example by means of at least a ball (29) mounted in a ramp (290) of ring (30). In the alternative embodiment, the purge ring (30) is housed within the axial drill hole (320) of piston (32) and is extended on one end by a hollow shaft (300) which confines the control spring (31) in a cavity (320) thereby formed by piston (32) and purge ring (30). Furthermore, as watertightness may be ensured by an O-ring (27) placed between piston (32) and hollow shaft (300), the control spring (31) is then insulated from fluid flowing in the nozzle.

As for the lances of the prior art, the diffusion head may be moved through a guiding ring (36) attached, for example by screws, to the sliding ring (35). This guiding ring (36) enables an operator to have the sliding ring (35) slide on piston (32). The guiding ring (36) comprises a ball (291) slipping on a helical ramp (2910) provided in piston (32). Thus, by screwing or unscrewing the ring (35), the slipping of ball (291) in ramp (2910) also causes the guiding ring (36) to slide on piston (32) and consequently the sliding ring (35) to slide.

The purge ring (30) also enables the piston (32) to be moved manually, when this is necessary, for example when it is necessary to empty the conduit connected to the lance when the fluid supply is cut off. In this scenario, the fluid's flow rate is insufficient and piston (32) is then in contact with valve (44), which prevents flow of fluid. It is therefore desirable to be able to push back the piston (32) manually in order to discharge the fluid.

For this purpose, the purge ring (30) is rotatably attached with piston (32), for example through at least an anti-rotation screw (34). Also, as previously explained, the purge ring is translatably attached to sleeve (11) by means of at least a ball (29). This ball is able to slip in a helical ramp (290) provided in the purge ring (30).

The purge operation is performed as follows. Firstly, the guiding ring (36) is manoeuvred in order to bring ball (291) connecting the guiding ring (36) to piston (32), in abutment with ramp (2910). In this situation, ball (291) may no longer slide on piston (32). Further rotation of the guiding ring (36) therefore causes rotation of piston (32) and through attachment, rotation of purge ring (30). Rotation of purge ring (30) causes sliding of ball (29) connecting purge ring (30) to sleeve (11). Sliding of ball (29) is performed in the helical ramp (290) of sleeve (11). Thus, by following the helical ramp (290), the ball (29) causes the purge ring (30) to slide back and therefore causes a recoil of piston (32) which is translatably attached to purge ring (30).

Figure 1:
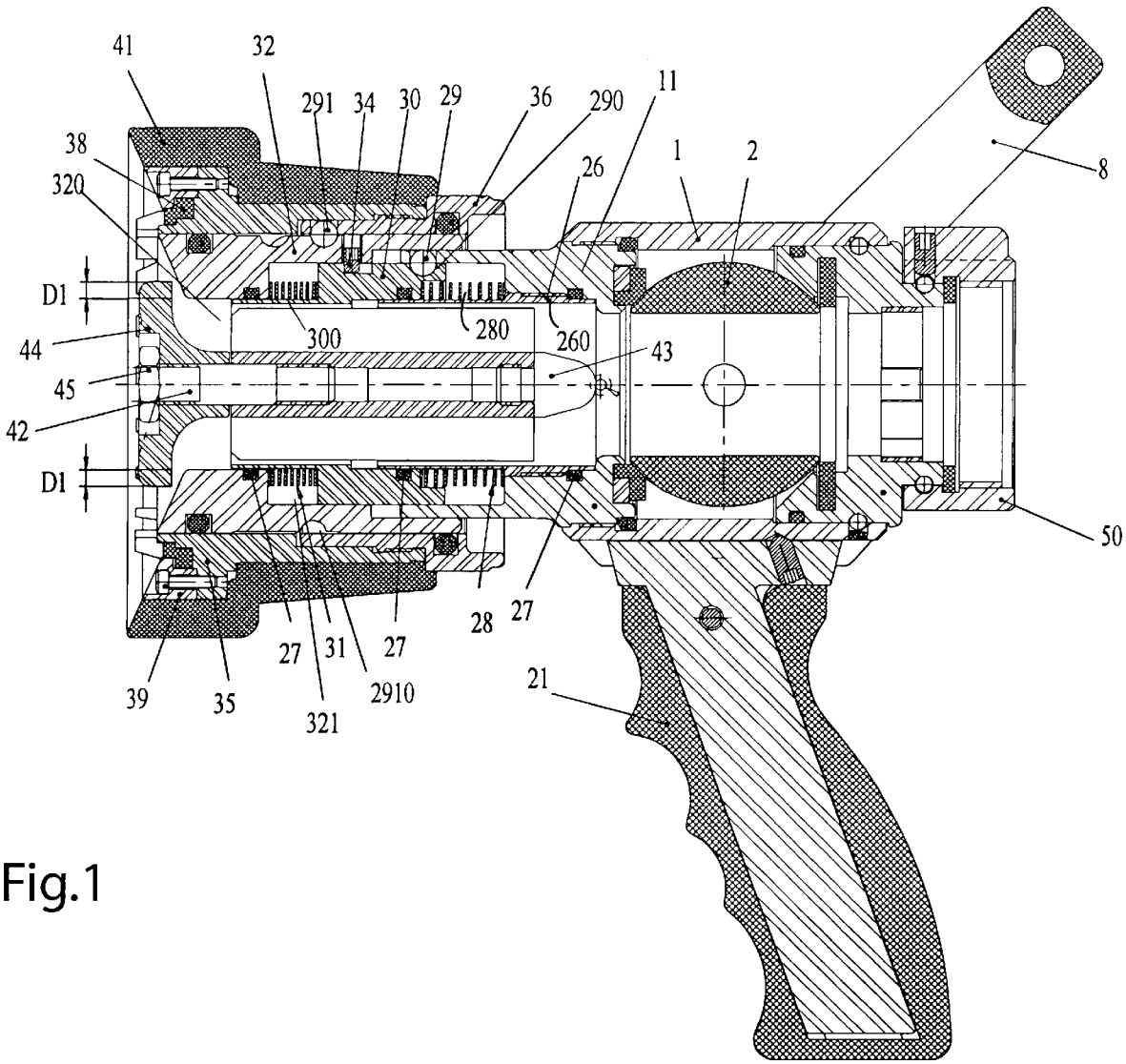
FIG. 1 shows a longitudinal sectional view of a fire hose lance according to the invention.

In the alternative illustrated in FIG. 1, restoring means (28) are provided so that the piston (32) is drawn back to its working position, i.e. so that the piston ensures pressure control. These restoring means comprise a coil spring (28) housed in the axial drill hole (321) of piston (32) and the axis of which coincides with the axis of the drill hole (320). A first end of spring (28) is attached to purge ring (30) and the second end is attached to body (1) or to a fixed portion relatively to body (1). In the alternative embodiment in FIG. 1, spring (28) is housed in a watertight cavity (280) formed by sleeve (11), purge ring (30) and cross-piece (26) which is then extended by a hollow shaft (260). Watertightness of the cavity (280) of spring (28) is provided by O-rings (27) placed between purge ring (30) and the hollow shaft (260) of cross-piece (26) and between cross-piece (26) and sleeve (11) of the nozzle. Upon purging the nozzle, i.e. when the purged ring (30) is pushed backwards by rotation of ring (36), spring (28) is compressed. When the clamping ring (36) is no longer rotatably stressed, spring (28) relaxes by exerting sufficient force on purge ring (30) so as to cause the ball (29) connecting guiding ring (30) to sleeve (11) to slip in its ramp and therefore cause purge ring (30) and piston (32) to slide back to their initial position. Spring (28) also prevents any untimely movement of the purge ring (30).

Thus, the fire hose lance according to the invention, is characterized in that the valve (44) is fixedly mounted on body (1), piston (32) is slidably mounted in body (1), whereby movement of the piston (32) is caused on the one hand by the resulting force from the fluid's total pressure exerted on surface (D1) of the piston located opposite the valve (44) and on the other hand by the force exerted by the restoring means (31) which tends to neutralize the force resulting from the total pressure of the fluid.

In another embodiment, the restoring means are mounted in a watertight cavity of body (1) formed in the axial drill hole (320) of the piston.

In another embodiment, the restoring means (31) comprise a coil spring the axis of which is parallel to the axis of piston (32) and a first end of which is attached to piston (32) and the second end of which is attached to a fixed portion or component relatively to body (1).

In another embodiment, the lance comprises purging means mounted in a watertight cavity of body (1).

In another embodiment, the purging means comprise a guiding ring (36) mounted on the external surface of piston (32) and a purge ring (30) fixed relatively to piston (32) and sliding in body (1), wherein the sliding of purge ring (30) is caused by rotation of guiding ring (36) and this causes the piston (32) to slide so as to increase the distance between valve (44) and piston (32).

In another embodiment, the purging means comprise restoring means (28) stressing the purge ring (30) in order to bring piston (32) back into its working position, when the guiding ring (36) is no longer rotatably stressed.

In another embodiment, the restoring means comprise a coil spring (28) the axis of which is parallel to the longitudinal axis of piston (32), a first end of the spring is fixed on the purge ring (30) and the second end of the spring is fixed onto body (1) or onto a fixed component relatively to body (1).

It should be apparent to those skilled in the art that the present invention provides embodiments under a great number of other specific forms without departing from the field of application of the invention as claimed. Accordingly, the present embodiments should be considered as illustrative but they may be altered within the field defined by the scope of the following claims.

What is claimed is:

1. A fire hose lance comprising:

a body including a pressure control device;

said pressure control device including a valve fixedly mounted on the body and a piston slidably mounted on the body, said piston having an axial drill hole in part defining a passage for flowing fluid through the body and which passage part is in part closed by said valve, said piston lying concentrically about said axial hole and in part surrounding said valve;

said piston being slidably movable along said body relative to said valve fixed to said body in response to a resulting force from pressure of the fluid flowing through said passage part applied to a surface of the piston located opposite said fixed valve and a biasing force exerted by a restoring means tending to neutralize the resulting force from the fluid pressure applied to the piston.

2. A fire hose lance according to claim 1 wherein said body includes a watertight cavity formed in the axial hole of said piston, said restoring means being mounted in said watertight cavity.

3. A fire hose lance according to claim 1 wherein said restoring means includes a coil spring having an axis parallel to an axis of the piston and a first end bearing against said piston and a second end bearing against a component fixed to said body.

4. A fire hose lance according to claim 1 wherein said body has a watertight cavity and a purging means mounted in said watertight cavity of said body.

5. A fire hose lance according to claim 4 wherein said purging means includes a guiding ring rotatably carried by and on an external surface of said piston and a purge ring fixed relative to said piston and slidable on said body, rotation of said guiding ring causing sliding of said purge ring and a sliding of the piston relative to said body to increase the distance between said valve and said piston.

6. A fire hose lance according to claim 5 wherein the purging means comprises a restoring means acting on the purge ring to displace the piston into a working position when the guiding ring is no longer rotatable.

7. A fire hose lance according to claim 6 wherein the restoring means comprises a coil spring having an axis parallel to a longitudinal axis of the piston, a first end of said spring being fixed on said purge ring and a second end of said spring being fixed relative to said body.

* * * * *